US006341387B1

(12) United States Patent
Zars

(10) Patent No.: US 6,341,387 B1
(45) Date of Patent: Jan. 29, 2002

(54) SAFETY DEVICE AND METHOD FOR SWIMMING POOL DRAIN PROTECTION

(76) Inventor: Leif Alexander Zars, 438 Sandau Rd., San Antonio, TX (US) 78216

( * ) Notice: Subject to any disclaimer, the term of this patent is extended or adjusted under 35 U.S.C. 154(b) by 0 days.

(21) Appl. No.: 09/714,365

(22) Filed: Nov. 16, 2000

Related U.S. Application Data

(63) Continuation-in-part of application No. 09/439,875, filed on Nov. 12, 1999, now abandoned.

(51) Int. Cl.[7] ..... E04H 4/06
(52) U.S. Cl. ..... 4/504; 4/509
(58) Field of Search ..... 4/504, 507, 509, 4/541.1; 137/216.1

(56) References Cited

U.S. PATENT DOCUMENTS 4,115,878 A * 9/1978 Johnson et al. ..... 4/509 X
4,602,391 A * 7/1986 Shepherd ..... 4/504 X
5,167,041 A * 12/1992 Burkitt, III ..... 4/509 X
5,499,406 A * 3/1996 Chalberg et al. ..... 4/504 X
5,682,624 A * 11/1997 Clochetti ..... 4/509
5,822,807 A * 10/1998 Gallagher ..... 4/507
5,822,808 A * 10/1998 Esser ..... 4/541.1
5,991,939 A * 11/1999 Mulvey ..... 4/504

* cited by examiner

*Primary Examiner*—Robert M. Fetsuga
(74) *Attorney, Agent, or Firm*—Akin, Gump, Strauss, Hauer & Feld, L.L.P.

(57) ABSTRACT

The present invention entails a prefabricated safety device and method for installing the device in any swimming pool and that is capable of eliminating dangerous vacuum pressure created in the main drain line of a pool when an object or person becomes trapped against the drain or other suction line inlet of a swimming pool recirculating pump system. The vacuum elimination safety device is prefabricated and is a complete kit (unit) that can easily be installed directly onto the main drain suction line of any swimming pool recirculating pump system.

10 Claims, 10 Drawing Sheets

SAFETY DEVICE AND METHOD FOR SWIMMING POOL DRAIN PROTECTION

RELATED APPLICATIONS

This is a continuation in part of application Ser. No. 09/439,875, filed on Nov. 12, 1999, abandoned.

BACKGROUND OF THE INVENTION

The present invention relates to a drain suction relief device and method for installing it on swimming pools and more particularly concerns a prefabricated safety device for installation in new and existing pools to avoid an object or person being trapped below water or harmed by a swimming pool drain inlet from the suction from a swimming pool recirculating pump system.

Unfortunately, accidents occur whereby individuals, usually children and young adults, are trapped by the suction created in a swimming pool recirculating system at the inlet of a main drain in such a system. The hair of the individual may be sucked into the drain and/or a body part may obstruct or block the drain, thereby forming a vacuum in the main drain line. This vacuum may prevent the person, particularly a child, from escaping; often leading to serious injury, drowning when trapped below the water surface or even disembowelment where a person is seated on the drain.

This severe problem has resulted in many attempted and varied solutions. Examples of such prior art are U.S. Pat. No. 4,115,878 to Johnson, et al., U.S. Pat. No. 4,602,391 to Shepherd, U.S. Pat. No. 5,499,406 to Chalberg, et al., which disclose safety devices which are integrally designed and incorporated into the structure of the whirlpool baths or spas for which they are intended. Further attempts in the prior art are disclosed in U.S. Pat. No. 5,682,624 to Ciochetti, and U.S. Pat. No. 5,822,808 to Gallagher, et al. which use valves with moving parts that are triggered upon the creation of a vacuum. Other attempts, such as U.S. Pat. No. 5,167,041 to Burkitt, utilize pressure sensors and water level sensors that activate switches that turn off the pump. Also, vacuum release vertical pipes have been used on pools before. The present invention, as distinguished from the prior art, takes the form of an "add on" kit that is prefabricated and suitable for retrofitting existing swimming pool recirculating systems, as well as for use in new systems. The invention has no moving parts, is made from simple pipes familiar in the art, and is not subject to wear nor requires maintenance. It eliminates the need to do calculations, design work or fabrication work when installing such a safety device on a pool. The invention is suitable for virtually any swimming pool recirculating system, regardless of pump capacity, line size, or pool depth, and maintains the integrity of the existing recirculating system without need for reconfiguration or redesign.

SUMMARY OF THE INVENTION

The present invention entails a safety device capable of eliminating the vacuum created in the main drain line of a pool when an object or person obstructs or becomes trapped against the drain or other suction line inlet of a swimming pool recirculating pump system. The vacuum elimination safety device is installed in the main drain suction line of the swimming pool recirculating pump system. The present invention is constructed through installing one end of an interior vertical pipe fluidly connected to the main drain suction line in a "T"-type connection with the second end opening downward. The interior vertical pipe is enclosed within an exterior vertical sump pipe of larger diameter that is closed at the bottom end and vented to the atmosphere at the top. The configuration of the vertical pipes creates a column of water that is vented to the atmosphere during normal operation of the swimming pool recirculating system. When the main drain of the swimming pool is blocked or obstructed, thereby creating a vacuum at the point of the obstruction or blockage, the water within the column created by the present invention is evacuated and the suction is broken as air is pulled through the open vent of the invention. Suction is interrupted, and the vacuum created at the point of the obstruction or blockage is eliminated, thereby allowing removal of the obstruction or blockage.

A principal object of the present invention is to provide an improved safety device for use in a swimming pool recirculating pump system that eliminates the vacuum created when the intake to the recirculating pump system is obstructed or blocked. The pump intake may be obstructed or blocked by a person, and more particularly a child or young adult, resulting in serious injury or death through suction disembowelment, or drowning through suction entrapment or hair entanglement.

Another object of the present invention is to provide a safety device that is not dependent on electric, mechanical, or magnetic components for operation in eliminating the vacuum created when a pool suction line is obstructed or blocked. The present invention uses gravity and a simple pipe configuration rather than valves, sensors, or switching components. It is therefore very unlikely that the device will fail as a result of wear or interruption of power. Further, the components of the present device will not need maintenance or replacement. Lastly, the present device is not capable of a "false" shut off of the swimming pool recirculating pump system through the inadvertent activation of a valve or sensor.

Yet another object of the present invention is to limit the suction head created by a swimming pool recirculating pump to a minimum usable level regardless of the size or strength of the pump.

An additional object of the present invention is that it may be installed as a "kit" on virtually any pool, whether new or existing. The invention is intended to be self-contained and made of materials familiar in the art, preferably polyvinyl chloride (PVC) piping, The exact limiting quantity of suction is determined by the internal dimensions and arrangement of the piping and sump.

The device is not limited by the configuration of the swimming pool recirculating pump system and drains, the pump or line size, the depth of the pool, or whether the elevation of the swimming pool recirculating pump is located above the level of water in the pool, at water level, or below water level. Regardless of the pool's configuration, the device can be installed in the main drain suction line with the top of the device extending approximately 6" above the pool water level. Moreover, the hydraulics of the device will operate uniformly regardless of the pool configuration. Therefore there is no need for measuring or modification specific to the pool system on which the safety device is being installed. Also, because the device only requires that a relatively shallow excavation be dug close to the edge of the pool, installation in new systems and retrofit of existing systems is simple and inexpensive.

BRIEF DESCRIPTION OF THE DRAWINGS

The aforementioned objects and advantages of the present invention, as well as additional objects and advantages thereof will be more fully understood hereinafter as a result of a detailed description of preferred embodiments of the invention when taken in conjunction with the following drawings in which.

DETAILED DESCRIPTION OF PREFERRED EMBODIMENTS

The invention illustrated in the Figures provides a safety device capable of eliminating the vacuum created in the main drain line of a pool when an object or person obstructs or becomes trapped against the drain or other suction line inlet of a swimming pool recirculating pump system.

Figure 1:
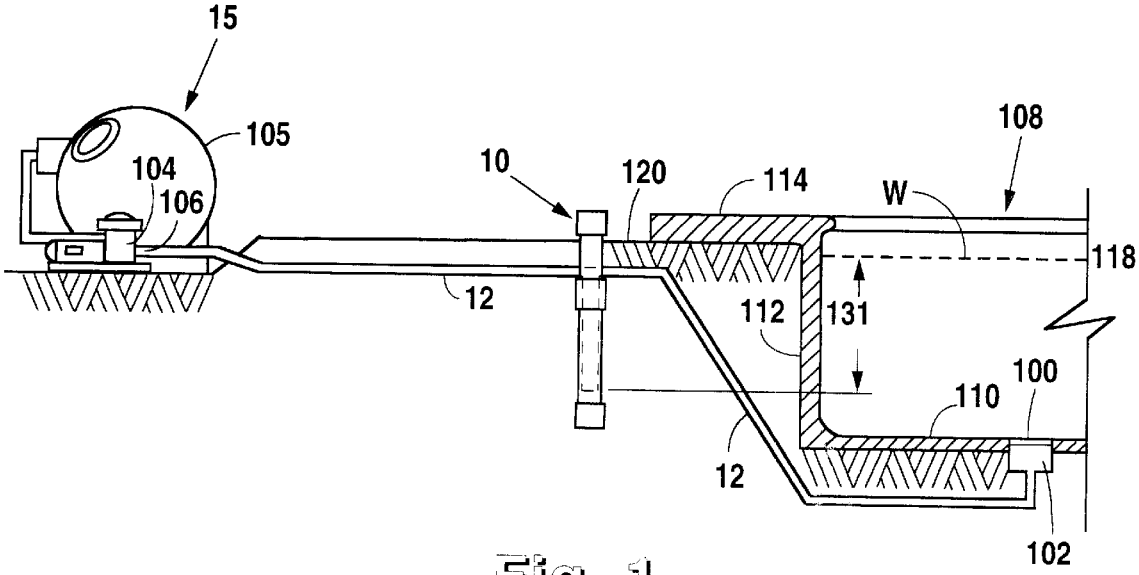
FIG. 1 is a cross-sectional view of a portion of a swimming pool illustrating the configuration of a standard swimming pool recirculating pump system, and further showing the invention installed in the main drain suction line.

Shown in FIG. 1 is a representation of a swimming pool 108 having a floor 110, a side wall 112, and a deck 114 that is conventionally equipped with a conventional pump and filter system 15 having a filter 105 and recirculating pump 104 that draws water from the pool 108. The specific design and configuration of the conventional filtration or recirculation system 15 is not part of or critical to the operation of the present invention. As illustrated, the pool 108 is equipped with an outlet 100 located in the floor 110 of the pool 110 at its deepest point, although it is foreseeable that the pool 108 could be equipped with multiple drains or suction line inlets at various locations in the pool 108. The outlet 100 illustrated in FIG. 1 is commonly referred to as the main drain of the pool 108 because a majority of the water W pumped from pool 108 through the filtration or recirculation system by pump 104 is drawn through the outlet 100. As is conventional, a suction line 12 is provided that fluidly interconnects the outlet 100 at connection 102 and the pump 104 at connection 106. Suction line 12 is most commonly cylindrical, has an interior surface 14 and an exterior surface 16, and is commonly buried at a variable depth beneath the surface of the ground 120.

Figure 2A:
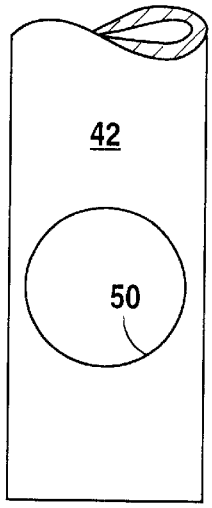
FIG. 2*a* is a cross-sectional front view of the vertical top pipe of the present invention.
Figure 2B:
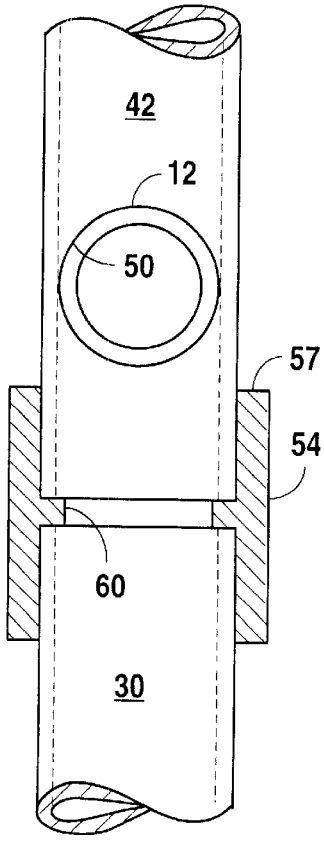
FIG. 2*b* is a cross-sectional front view of the present invention.
Figure 2:
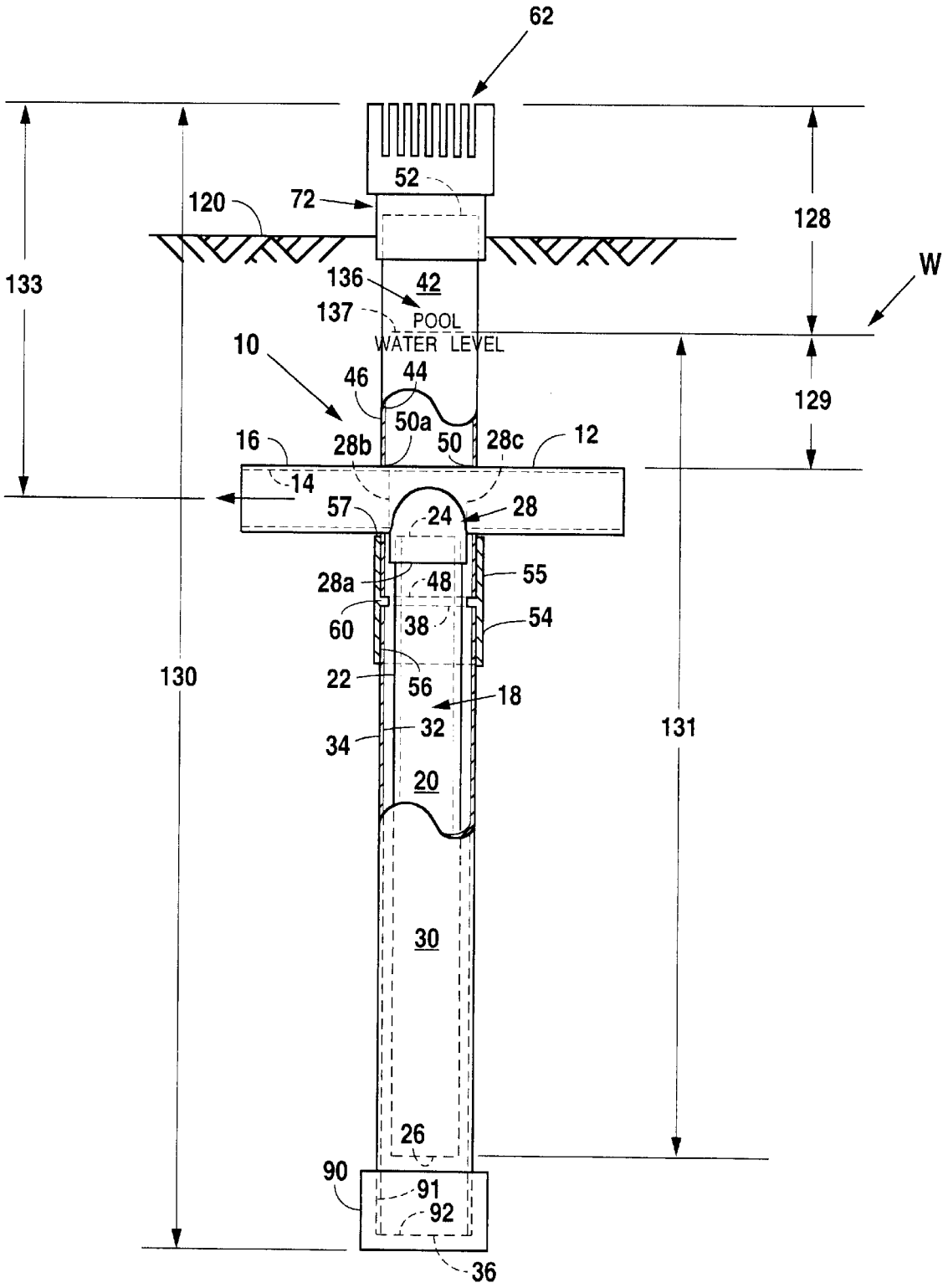
FIG. 2 is a cross-sectional side view of the present invention.

In accordance with the present invention, the pool 108 is further equipped with a vacuum elimination safety device 10 as represented in FIG. 1, and shown in greater detail in FIG. 2. The device 10 is designed to vent the suction line 12 to the atmosphere in the event that the outlet 100 becomes blocked or obstructed, such that the suction of the pump 104 is immediately and completely removed. As a result, the vacuum that would otherwise trap the obstruction against the outlet 100 is immediately released, allowing the obstruction to be easily released or removed. In the situation where a young adult or child obstructs the outlet 100, the person may then swim to safety or be easily assisted by others. The elevation of the pump has no influence on the operation of this vacuum elimination device.

FIG. 2 illustrates a suitable construction for the safety device 10, but not the only construction and design for the device 10 in terms of performing the desired function. The device 10 as illustrated, however, embodies several features that make the device 10 particularly suited for its intended use. As shown in FIG. 2, the device 10 is generally constructed as a prefabricated unit or kit using a cylindrical interior vertical sump pipe 18 having an interior surface 20 and an exterior surface 22 and terminating at two ends, the top end 24 being fluidly interconnected with and perpendicular to suction line 12 at T-shaped saddle connector 28 and the bottom end 26 opening downward opposite the surface of the ground 120.

The T-shaped saddle connector 28 has a downwardly extending cylindrical connection portion 28*a* which receives and connects to the top end 24 of interior vertical sump pipe 18. Connector 28 has two horizontally extending cylindrical portions 28*b* and 28*c* which connect to pipes or lines 12 when the device 10 is installed into line 12. The cylindrical portions 28*a*, 28*b* and 28*c* are connected to the saddle T connector 28 with standard PVC adhesive to connect to the pipes or lines. The portions 28*b* and 28*c* extend through and are sealed to the opposed cut outs 50 and 50*a* in the bottom portion 48 of vertical top pipe 42, as shown in FIG. 2*b*, with conventional sealant and adhesive.

The interior vertical sump pipe 18 is enclosed in a cylindrical exterior vertical pipe 30 which is a continuation of top pipe 42 via coupling 54 having an interior surface 32 and an exterior surface 34 and terminating at a bottom end 36 and a top end 38. Although the pipes are standard cylindrical pipes, other shapes such as square pipe could also be used. In lieu of standard cylindrical pipes, the safety relief device 10 could be fabricated as an injection molding or by any other standard manufacturing technique. The interior surface 32 of exterior vertical pipe 30 has a diameter larger than exterior surface 22 of interior vertical sump pipe 18. The bottom end 36 of exterior vertical pipe 30 and inner surface 92 of cap 90 extend beyond the bottom open end 26 of interior vertical sump pipe 18. The bottom end 36 of exterior vertical pipe 30 is fitted with the cap 90 to form an enclosed sump. Cap 90 has an inner cylindrical surface 91 that tightly fits on the outer surface of the exterior surface 34 of the exterior vertical pipe 30. Exterior vertical pipe 30 is sealed by cap 90 through application of conventional adhesive or sealant of the type commonly known in the art at the contact between exterior surface 34 of exterior vertical pipe 30 and inner surface 91 of cap 90.

The top end 38 of exterior vertical pipe 30 is connected to cylindrical coupling 54. Coupling 54 has an exterior surface 55 and an interior surface 56 having an annular ridge 60 at the longitudinal midpoint of coupling 54, and terminates at open top end 57 and open bottom end 58. The interior surface 56 of coupling 54 has a circumference equal to the circumference of exterior surface 34 of exterior vertical pipe 30. The top end 38 of exterior vertical pipe 30 is fitted into the bottom end 58 of cylindrical coupling 54 so that the top end 38 of exterior vertical pipe 30 abuts annular ridge 60. Bottom end 58 of coupling 54 is connected to top end 38 of exterior vertical pipe 30 through application of conventional adhesive or sealant of the type commonly known in the art at the contact between exterior surface 34 of exterior vertical pipe 30 and interior surface 56 of coupling 54.

Top end 57 of coupling 54 is connected to the bottom end of vertical top pipe 42. Vertical top pipe 42 is cylindrical, has interior surface 44 and exterior surface 46, and terminates at open bottom end 48 and open top end 52. Bottom end 48 of vertical top pipe 42 has a cylindrical cut out 50 as illustrated in FIG. 2*a* of a diameter equivalent to the diameter of exterior surface 16 of suction line 12. Cut out 50 allows pipe 28*b* and 28*c* to be carried through vertical top pipe 42 being sealed thereto with application of conventional adhesive or sealant of the type commonly known in the art at the contact between 28*b* and 28*c* and 42.

Bottom end 48 of vertical top pipe 42 is connected to top end 57 of coupling 54 as shown in FIG. 2*b*. Bottom end 48 of vertical top pipe 42 is fitted into the top end 57 of cylindrical coupling 54 so that bottom end 48 of vertical top pipe 42 abuts annular ridge 60. Top end 57 of coupling 54 is connected to bottom end 48 of vertical top pipe 42 through application of conventional adhesive or sealant of the type commonly known in the art at the contact between exterior surface 46 of vertical top pipe 42 and interior surface 56 of coupling 54.

The top end 52 of vertical top pipe 42 extends beyond the connection 28 between interior vertical sump pipe 18 and suction line 12 to an elevation equivalent to ground surface 120. The top end 52 of vertical top pipe 42 is open and fitted with a cap 62 by coupling 76 that allows ventilation of safety device 10 to the atmosphere but protects against blockage or obstruction.

Figure 3:
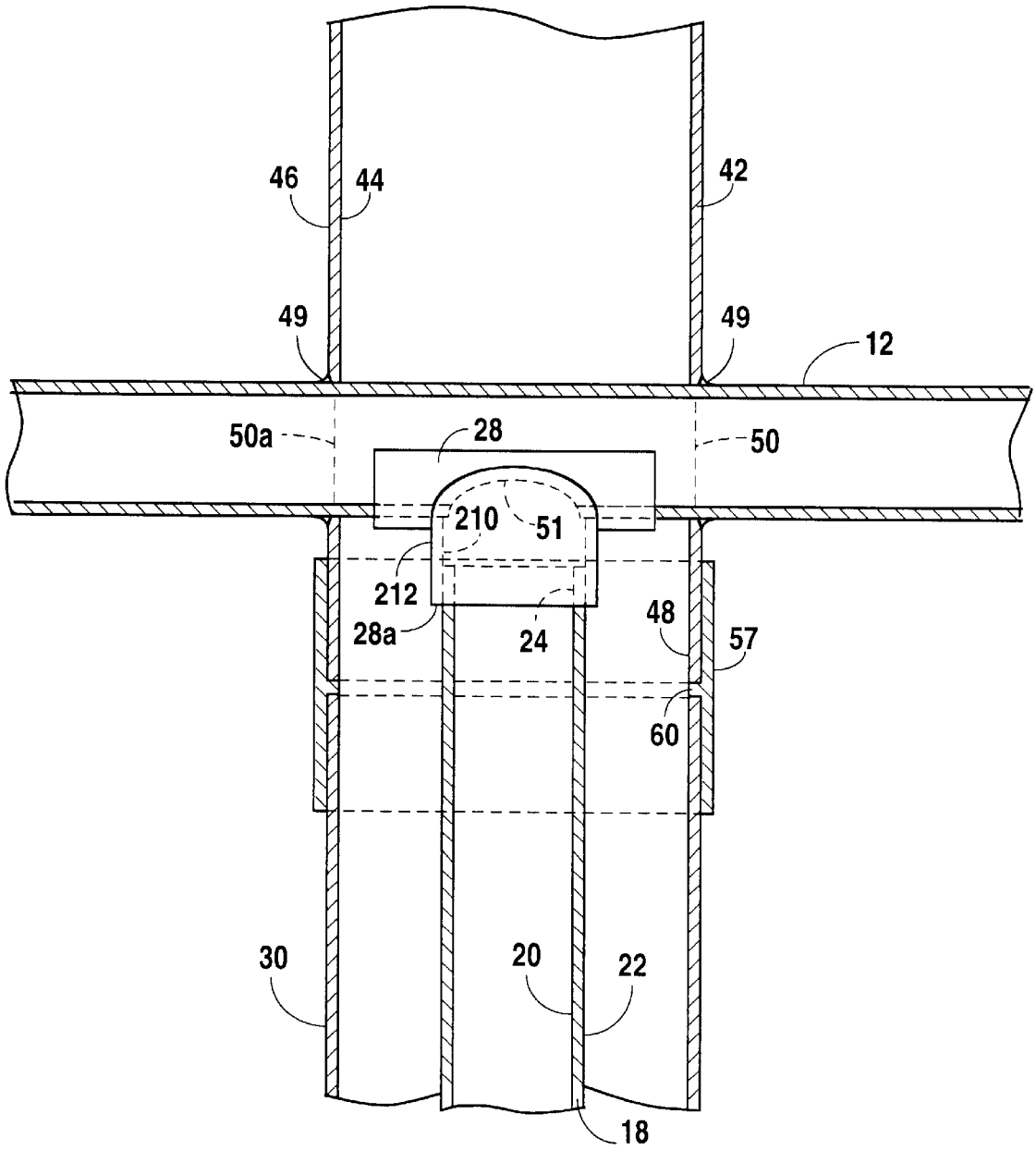
FIG. 3 is a cross-sectional front view of the interface between the coupling of the vertically disposed pipes and the horizontally-disposed suction line of the present invention.
Figure 3A:
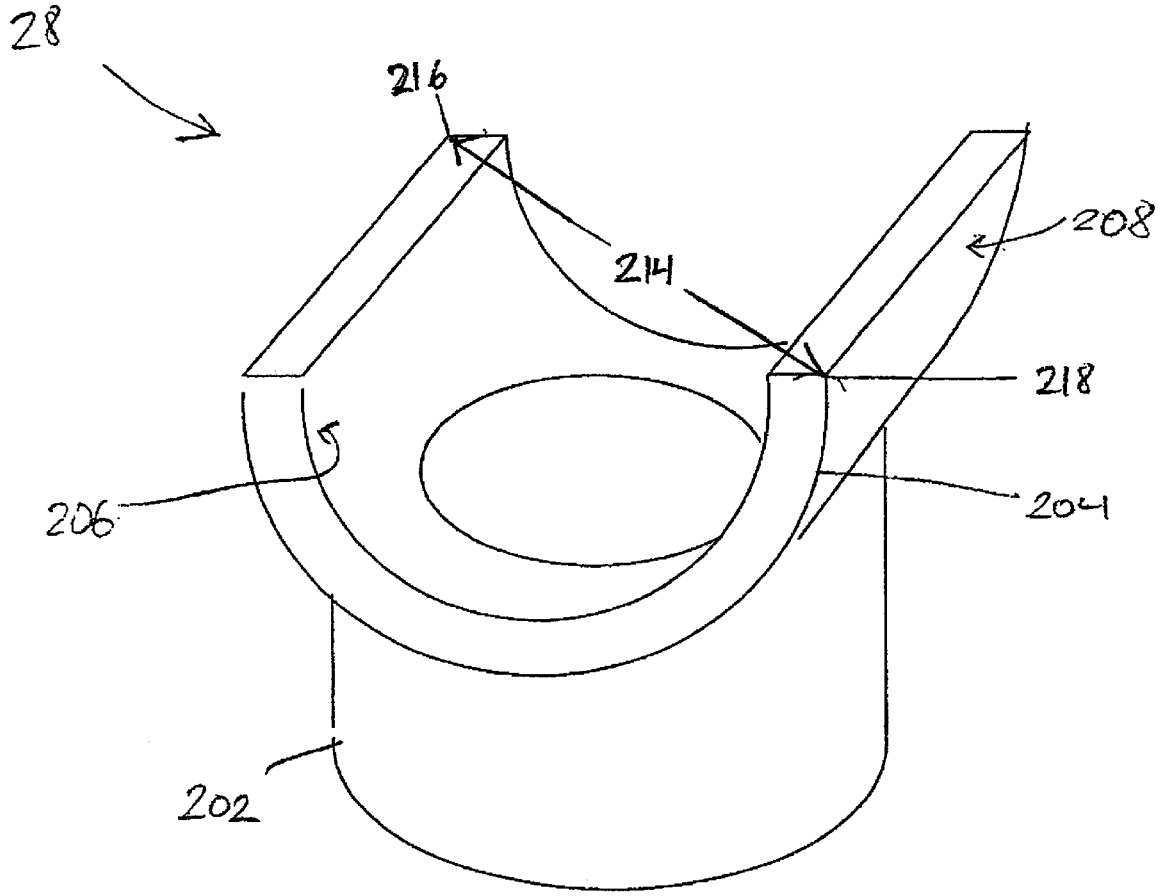
FIG. 3*a* is a perspective view of a connector piece.

FIGS. 3 and 3*a* show a preferred embodiment for the connection between the suction line 12 and the safety device 10 of FIG. 2. In this embodiment, a hole 51 is provided through the exterior surface 16 of suction line 12, from which water W flowing through line 12 can ingress and egress. Suction line 12 is fed through cut-outs 50 and 50*a* in vertical top pipe 42 so that hole 51 is enclosed within top pipe 42. The exterior surface 16 of suction line 12 is mated and sealed to the PVC weldment 49 of top pipe 42 that surround hole 51. The contact between suction line 12 and the weldment 49 of vertical top pipe 42 is sealed together with application of conventional adhesive or sealant commonly known in the art.

In FIG. 3*a* the saddle shaped connector 28 described in FIG. 2 is shown. Here, connector 28 has a lower cylindrical portion 202 and an open semi-cylindrical upper portion 204 extending in an orthogonal direction to portion 202. Upper portion 204 has an inner surface 206 and an outer surface 208. Likewise, lower portion 202 has an inside surface 210 and an outside surface 212.

The connection between vertical top pipe 42, cylindrical coupling 54, and exterior vertical pipe 30 shown in FIG. 3 is identical to that described above for FIGS. 2 and 2*b*.

Figure 3B:
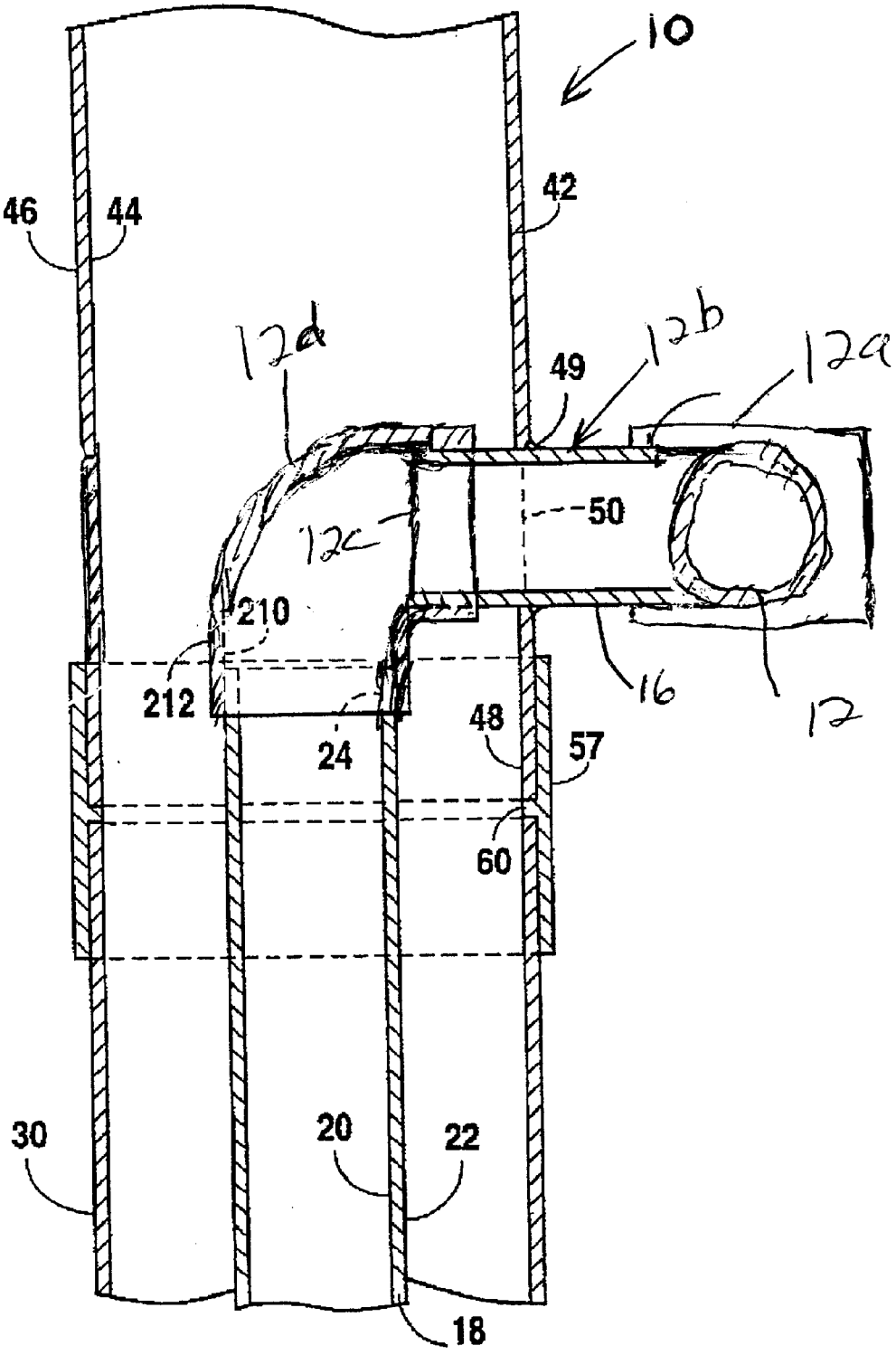
FIG. 3*b* is a cross-sectional front view of the interface between the coupling of the vertically disposed pipes and the horizontally-disposed suction line of another embodiment of the present invention.

FIG. 3*b* shows another embodiment for the connection between the suction line 12 and the safety device 10 of FIG. 2. In this embodiment, a T-shaped coupling 12*a* is connected to pipe 12*b* and suction line 12 is connected to the T-shaped coupling 12*a*, from which water W flowing through line 12 can ingress and egress. Pipe 12*b* extends through cut-out or hole 50 in vertical top pipe 42 and ends at 12*c*. The exterior surface of pipe 12*b* is mated and sealed to the PVC weldment 49 of top pipe 42 that surrounds pipe 12*b*. The end of pipe 12*b* is connected to an elbow 12*d* that is also connected to pipe 18. The contact between line 12*b* and the weldment 49 of vertical top pipe 42 is sealed together with application of conventional adhesive or sealant commonly known in the art.

After suction pipe 12*b* is fed through cut-out or hole 50 of top vertical pipe 42, elbow 12*d* is inserted up the interior of top pipe 42. Using an adhesive or sealant of a type commonly known in the art, the elbow 12*d* is connected matingly to the exterior surface of pipe 12*b* and pipe 18. The line 12 is generally perpendicular to the pipe 12*b*.

Figure 3C:
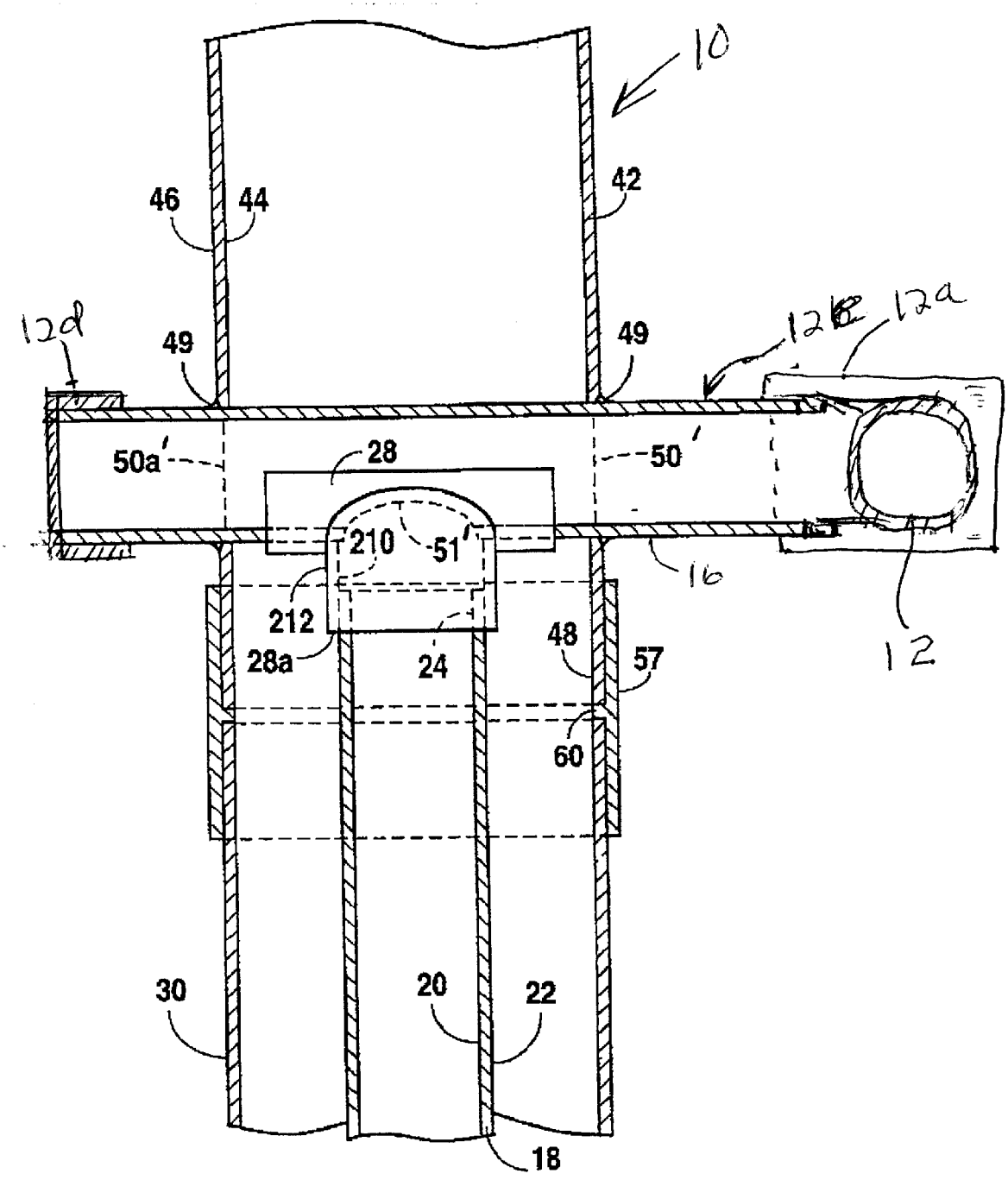
FIG. 3*c* is a cross-sectional front view of the interface between the coupling of the vertically disposed pipes and the horizontally-disposed suction line of another embodiment of the present invention.

FIGS. 3*c* shows another embodiment for the connection between the suction line 12 and the safety device 10 of FIG. 2. In this embodiment, a T-shaped coupling 12*a* is connected to pipe 12*b* and suction line 12 is connected to the T-shaped coupling 12*a*, from which water W flowing through line 12 can ingress and egress. In this embodiment, a hole 51' is provided through the exterior surface of pipe 12*e*, from which water W flowing through line 12 can ingress and egress. Pipe 12*e* is fed through cut-outs 50' and 50*a*' in vertical top pipe 42 so that hole 51' is enclosed within top pipe 42. The exterior surface 16 of pipe 12*e* is mated and sealed to the PVC weldment 49 of top pipe 42 that surround hole 51'. The contact between pipe 12*e* and the weldment 49 of vertical top pipe 42 is sealed together with application of conventional adhesive or sealant commonly known in the art. A standard cap 12d is secured to the end of line 12*e* with adhesive. The line 12 is generally perpendicular to the line 12*e*.

The embodiments of FIGS. 3*b* and 3*c* allow connection of the safety device to drain lines of varying sizes. This can be accomplished by varying the sizes of the two connections on the T-shaped connector 12*a* that connect to the drain line 12.

Figure 4:
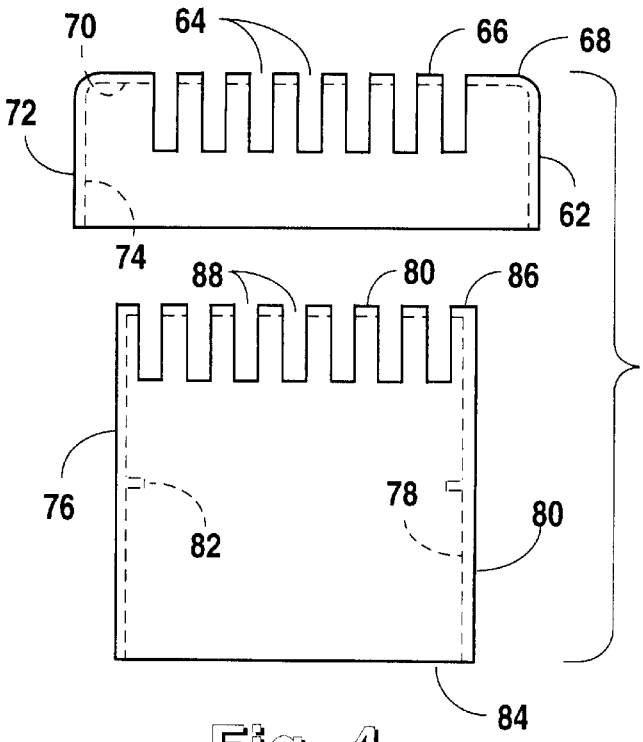
FIG. 4 is an exploded side view of the vented cap and the notched coupling that connects the vented cap to the vertical top pipe of the present invention.
Figure 5:
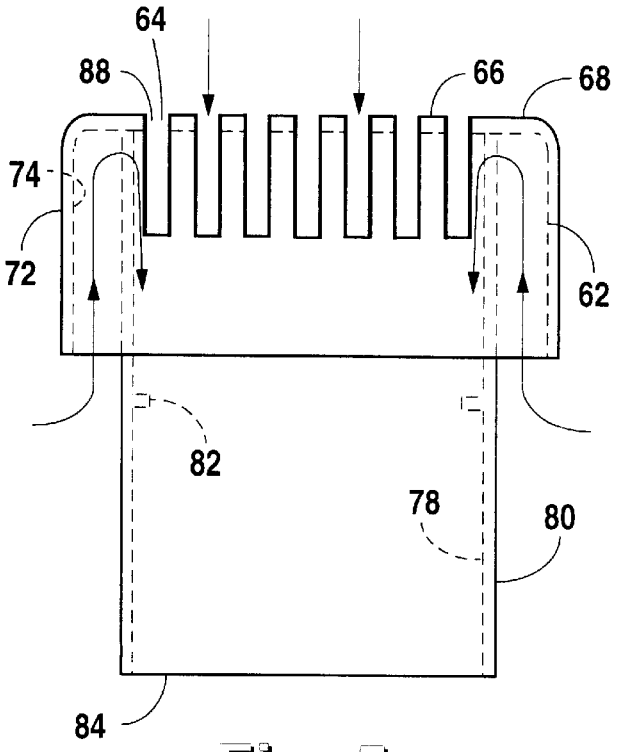
FIG. 5 is a side view as in FIG. 4, but with the vented cap fitted on the notched coupling and illustrating the flow of air into the present invention.
Figure 6:
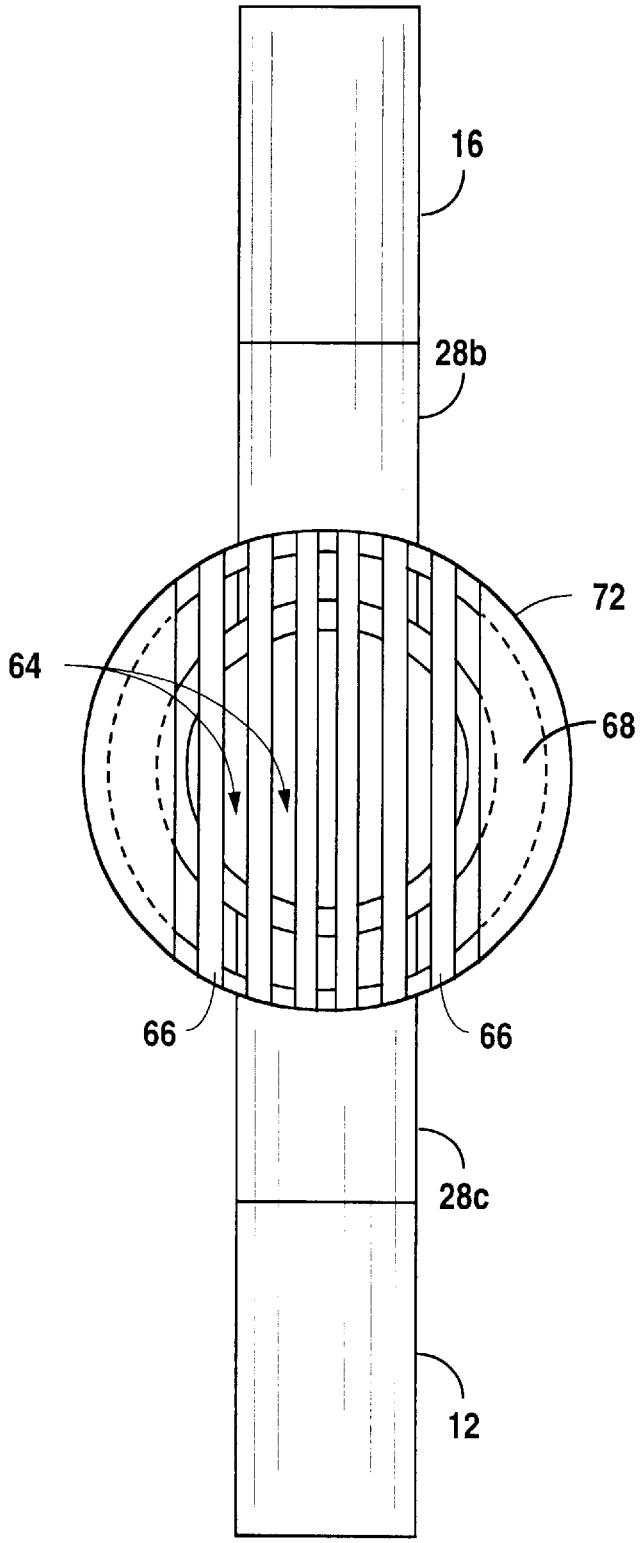
FIG. 6 is an top view of the vented cap fitted on the coupling in relation to the suction line.

FIG. 4 details cap 62 and coupling 76. Cap 62 has a top surface 68, a bottom surface 70, an outer side surface 72, and an inner side surface 74 of a larger diameter than the coupling 76 and exterior surface 46 of vertical top pipe 42. Cap 62 is vented with a plurality of apertures 64 extending longitudinally across and through the top 68 of cap 62 and forming a grate 66, as shown in FIG. 6. Coupling 76 has an exterior surface 80 and an interior surface 78 having an annular ridge 82 at the longitudinal midpoint of coupling 76, and terminates at open bottom end 84 and open top end 86. Top end 86 has a plurality of apertures or slots 88. The interior surface 78 of coupling 76 has a circumference equal to the circumference of exterior surface 46 of vertical top pipe 42. Cap 62 is fitted to top end 86 of coupling 76 through application of conventional adhesive or sealant of the type commonly known in the art at the contact between exterior surface 80 of coupling 76 and inner edge 74 of cap 62. Fitting cap 62 to coupling 76 allows apertures or slots 64 to align to apertures or slots 88 in the top end 86 of coupling 76, thereby venting vertical top pipe 42 to the atmosphere when fitted together as shown in FIG. 5.

The top end 52 of vertical top pipe 42 is fitted into the bottom end 84 of cylindrical coupling 76 so that the top end 52 of vertical top pipe 42 abuts annular ridge 82. Bottom end 84 of coupling 76 is connected to top end 52 of vertical top pipe 42 through application of conventional adhesive or sealant of the type commonly known in the art at the contact between exterior surface 46 of vertical top pipe 42 and interior surface 78 of coupling 76.

Figure 7:
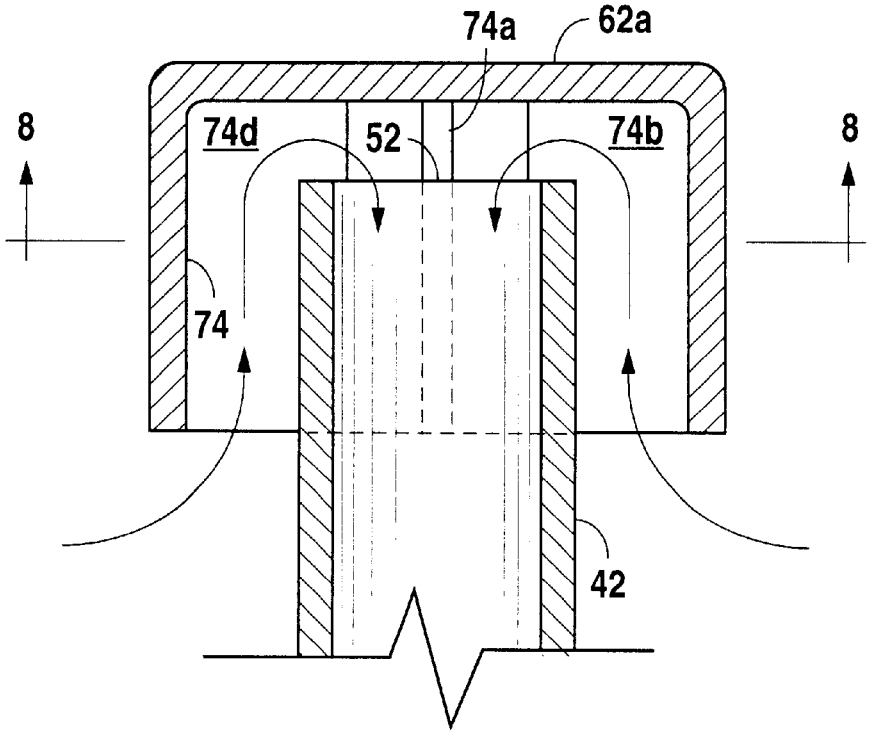
FIG. 7 is a cross-sectional side view of the present invention in the form of an alternative embodiment wherein a solid cap with spacers is fitted directly on the top end of the vertical top pipe and illustrating the flow of air into the alternative embodiment.
Figure 8:
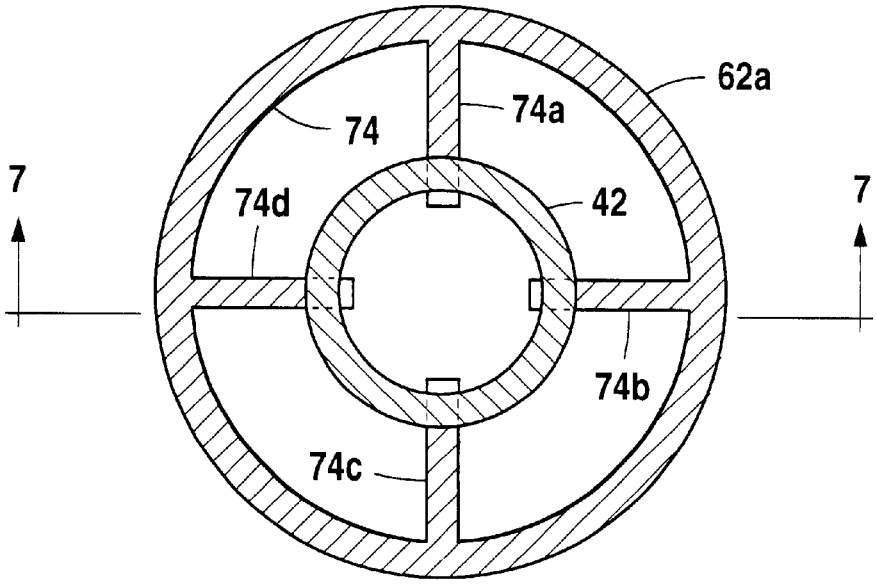
FIG. 8 is a cross-sectional elevation view of an alternative embodiment of the present invention utilizing a solid cap as shown in FIG. 7.

An alternative embodiment of the present invention is shown in FIGS. 7 and 8 wherein cap 62*a* has a plurality of radial flanges 74*a*, 74*b*, 74*c*, and 74*d* extending from inner surface 74, as shown in FIG. 7 that act as spacers between cap 62 and top end 52 of vertical top pipe 42 when cap 62 is fitted on vertical top pipe 42 as shown in FIG. 7. The flow of air through this alternative embodiment is detailed in FIG. 7.

Figure 9:
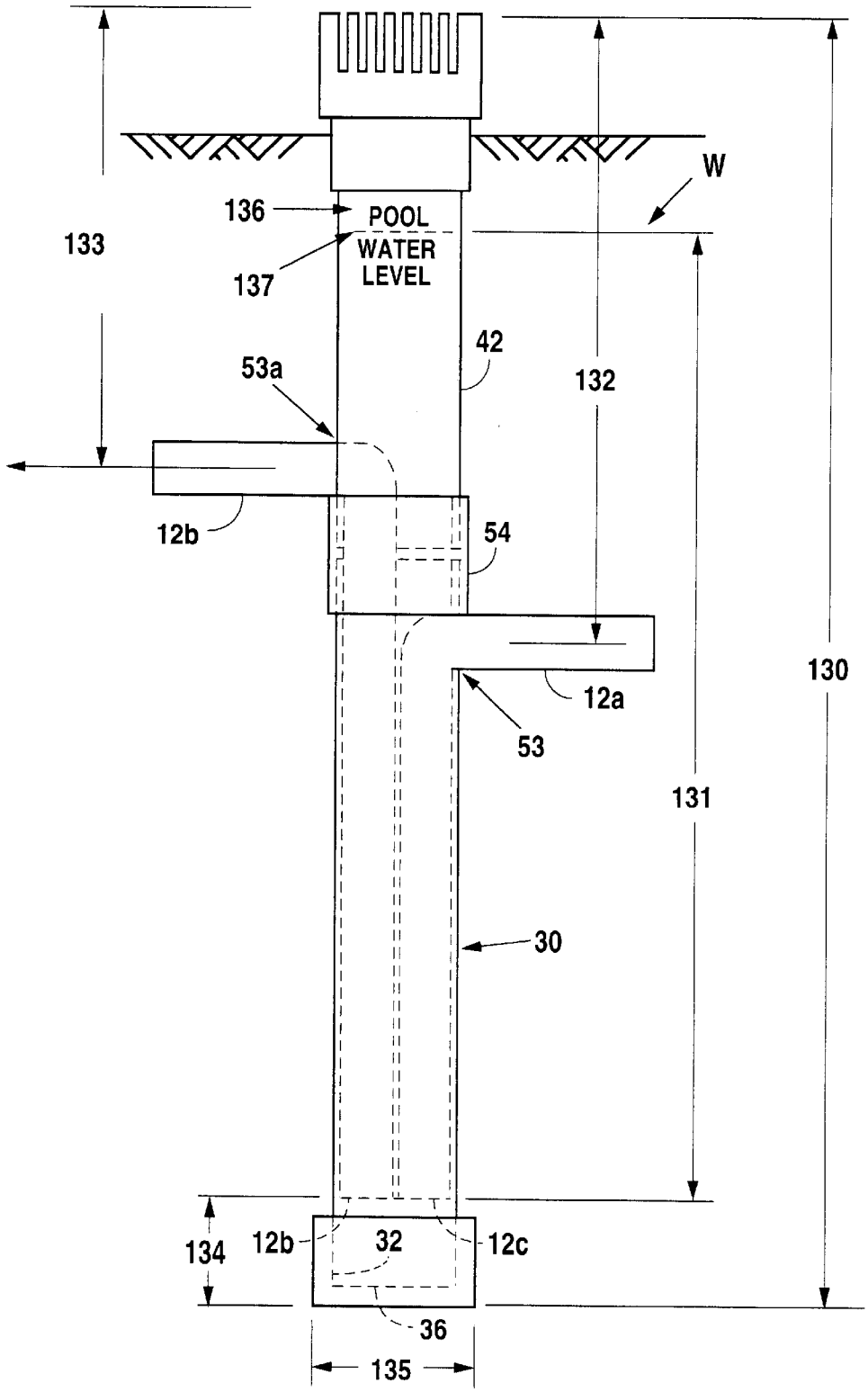
FIG. 9 is a side view of the present invention in the form of an alternative embodiment wherein the suction line from the pool into the invention and the suction line out of the present invention to the pump are separate pipes, each having a 90 degree bend and extending down into the exterior vertical pipe in substitution of the single interior vertical sump pipe connected to the suction line.

Another embodiment of the present invention is shown in FIG. 9, wherein suction line 12 is separated into two segments 12*a* and 12*b*. First segment 12*a* of suction line 12 runs from outlet 100 into exterior vertical pipe 30. First segment 12*a* of suction line 12 is extended through a cylindrical cut out or hole 53 in exterior vertical pipe 30 and directed downward inside vertical pipe 30, either through bending, molding, use of an elbow joint, or some other well-known method in the art, with the open end of first segment 12*a* of suction line 12 opening downward at a point 12*c* near the bottom end 36 of exterior vertical pipe 30. Conventional sealant is used to seal around hole 53. Second segment 12*b* of suction line 12 runs from exterior vertical pipe 30 to pump 104, with second segment 12*b* of suction line 12 extending into exterior vertical pipe 30 through a cylindrical cut out or hole 53*a* of vertical top pipe 42 in the identical manner as the open end of first segment 12*a* of suction line 12, the open end of second segment 12*b* of suction line 12 likewise opening downward at a point 12*d* near the bottom end 36 of exterior vertical pipe 30. Conventional sealant is used to seal around hole 53*a*. As shown in FIG. 9, interior vertical sump pipe 18 is not used. In this alternative embodiment, the diameter of interior surface 32 of exterior vertical pipe 30 is greater than two times the diameter of suction lines 12*a* and 12*b*.

According to the any of the embodiments described above, vertical top pipe 42, coupling 54, and exterior vertical pipe 30 act as a sump when safety device 10 is installed in the suction line 12. The configuration of the present invention allows water W to be drawn by gravity through outlet 100 into suction line 12 and into the safety device 10. The safety device 10 creates a vented sump whereby water W from suction line 12 is drawn through interior vertical sump pipe 18 and into exterior vertical pipe 30, rising to a level which is substantially equivalent in elevation to water level 118 in pool 108.

Referring to FIGS. 2 and 9, during normal operation, water W is drawn out of the safety device 10 through suction line 12 by pump 104. The flow of water W through suction line 12 initially draws water up from interior vertical sump pipe 18 or pipes 12*a* and 12*b*, dropping the level of water in exterior vertical pipe below the pool water level 137. A gravity-created static hydraulic head, equal and opposite to the force drawing the water up vertical pipe 18 or pipe 12b into suction line 12, is thereby formed within the safety device 10. The hydraulic head corresponds to the difference between the pool water level 118 and the water level in interior vertical pipe 18 or pipes 12*a* and 12*b*. If the safety device 10 has the proper dimensions, then during normal operation suction line 12 remains unvented to the atmosphere by the safety device 10, enabling pool 108 and its recirculation system to operate completely as designed and intended.

When a blockage or obstruction of outlet 100 occurs sufficient to cause the vacuum level within the suction line 12 to exceed the hydraulic head created by gravity in the safety device 10, pump 104 evacuates the water W out of the safety device 10 and draws air from the cap 62 down through vertical top pipe 42, further down through exterior vertical pipe 30, and then up through the interior vertical sump pipe 18 or suction line 12*b* into suction line 12. This causes the loss of suction, thereby eliminating the vacuum within suction line 12 and at outlet 100.

If the obstruction or blockage of outlet 100 is sufficiently brief, it is foreseeable gravity flow would return and that pump 104 could regain its prime and continue to operate normally. Where the obstruction or blockage is complete, however, such as when a person is trapped at outlet 100, there will be a complete loss of flow of water at pump 104. This will cause a complete loss of vacuum within suction line 12, allowing the person to be released or pull free from the suction and swim free by themselves or with the help of others or to prevent disembowelment due to even momentary entrapment. Due to the proximity of the invention to the outlet and the designed short distance between the typical interior operating water level in pipe 34 and bottom end 26 of pipe 30, the time delay for suction relief in the main drain is very short (may be less than a second) thus providing significantly greater protection against disembowelment.

It is important to note that the response time of safety device 10 is not dependent on the capacity of recirculating pump 104. High capacity pumps are often used in large commercial pools and under normal operating conditions, generate a stronger vacuum more rapidly than lower capacity pumps. The device of the present invention, however, limits the suction head of pump 104 to a maximum suction head designed into the safety device equal to the gravity-created hydraulic head in safety device 10, regardless of the capacity of pump 104. The benefits of the safety device 10 are equally appreciated under virtually all swimming pool recirculating system sizes and configurations.

A new and significant advantage of the present invention, seen in view of the above, is that existing swimming pool recirculating systems can be simply and readily retrofitted with the present invention through installation of the safety device 10 into suction line 12. This allows the benefits of the present invention to be realized without redesigning or reconstructing an existing recirculating system, performing any structural work on an existing swimming pool at great expense, or even draining and retrofitting the swimming pool. The existing configuration and flow characteristics of a swimming pool recirculating system can also be preserved.

According to the present invention, the safety device 10 may be prefabricated with the dimensions 128, 129, 130, 131, 132, 133, 134 and 135 set according to the size of the drain line 12. Also, the internal dimensions of safety device 10 may be prefabricated to limit suction at the swimming pool main drain to 2.2 PSI (or 4.5" Hg). Further, the head dimension 131 may be sized to allow the pump to withdraw water from the pool by gravity under normal circumstances when there is no blockage of the drain. Accordingly, the safety device 10 will rely solely on the forces of gravity for its operation, needing no adjustment, electricity, magnetism, or moving mechanical parts, and be relatively maintenance-free.

For example, a preferred embodiment for a two (2) inch drain would have the following dimensions: two inch diameters for PVC pipe connectors 28*b* and 28*c*; six inches for the distance 128 between a water level mark 137 on pipe 42 and the top 68 of cap 62; four feet six inches for the total length 130 of the safety device 10; three feet and nine and one-half inches for the distance 131 between the bottom end 26 of interior vertical sump pipe 18 to the water level mark 137 on pipe 42; and one foot and five inches for the distance 133 between a horizontal midpoint of suction line 12 and the top 68 of cap 62. Also, in this embodiment the exterior vertical pipe 30 would be three inch PVC pipe and the interior vertical sump pipe 18 could be two inch PVC pipe. With these preset dimensions, the safety device 10 could easily and quickly be installed in any pool having a two inch drain line by positioning the pool water level mark 137 at the same elevation at the normal pool water level W.

It is understood that the pool water level W varies between normal operating limits. This slight variance does not adversely affect operation of the pool safety device 10. The above dimensions may vary for a pool have having a smaller or larger drain line diameter. Since the drain line diameter is generally determined by the pump and pool size, kits can be prefabricated for common drain line sizes.

The present invention may be implemented by installing the safety device 10 into suction line 12 at some point between the outlet 100 and the pump 104. Such installation will most conveniently occur near the edge of the swimming pool deck 114 at a point where the suction line 12 is buried near the surface of the ground 120, thereby minimizing necessary excavation.

The key to installation is the position of the safety device 10 relative to the water level W in the pool 108. Since the dimensions 130, 131, 132, 133, 134 and 135 are already determined according to standard engineering calculations, the only variable for installation is positioning the safety device 10 relative to the water level W. One way to accomplish this is with a label 136 that includes the water level mark 137 around the pipe 42 and the words "POOL WATER LEVEL" on the pipe 42. An important criteria is that the top of pipe 42 is positioned so that there is a sufficient head of water in the vertically disposed pipes to allow normal flow through the drain line 12 without sucking all of the water out of the safety device 12 except when the swimming pool drain is blocked.

Should the safety device 10 be installed incorrectly (too high) then the maximum suction available at outlet 100 would be lower than the designed safety limit. Should it be installed too low then swimming pool water W would run out of the vent cap 62 and its installation would not be acceptable and the pool would drain down below its designed operating water level. In either case, safety device 10 would still safely control the maximum suction at outlet 100 to within its designed limit.

While the present invention has been described in terms of the preferred embodiments described above, it is apparent that one skilled in the art could adopt other forms. Accordingly, the scope of the invention is to be limited only by the following claims and their equivalents.

What is claimed is:

1. A prefabricated vacuum relief safety kit for preventing the entrapment of or harm to a swimmer at a suction outlet fitting in a swimming pool equipped with a pump for drawing water from the pool, the prefabricated vacuum relief safety kit comprising:

generally vertically disposed concentric pipes sized to provide a head of water sufficient to allow normal operation of a swimming pool pump;

generally horizontally disposed inlet and outlet connections for connecting to the drain line of a swimming pool;

an outlet exposed to the atmosphere to allow air to be drawn into the vertically disposed concentric pipes when the inlet is unable to draw water from a pool;

the vertical dimensions of the kit being predetermined by the desired built-in safe limitation of maximum suction by gravity generally limited to the pressure differential that can be attained by the fluid head;

and a marking device on the kit to indicate the elevation at which the kit is to be positioned according to the pool water level to provide proper operation of the prefabricated vacuum relief safety kit.

2. A prefabricated vacuum relief safety kit for a swimming pool as recited in claim 1 wherein the concentric pipes comprise a single external pipe and a single internal pipe.

3. A prefabricated vacuum relief safety kit for a swimming pool as recited in claim 1 wherein the concentric pipes comprise a single external pipe and at least two internal pipes.

4. A method for preventing the entrapment of or injury to a swimmer at a suction outlet fitting in a swimming pool equipped with a pump for drawing water from the pool, the method comprising the steps of:

connecting a prefabricated vacuum relief safety kit having generally vertically disposed concentric pipes sized to provide a head of water sufficient to allow normal operation of a swimming pool pump and generally horizontally disposed inlet and outlet connections for connecting to the suction outlet fitting of a swimming pool and an outlet exposed to the atmosphere to allow air to be drawn into the vertically disposed concentric pipes when the inlet to the kit is unable to draw water from a pool with the dimensions of the kit being predetermined according to the vertical dimensions of the kit being predetermined by the desired built-in safe limitation of maximum suction by gravity generally limited to the pressure differential that can be attained by the fluid head; and positioning a marking device on the kit which indicates the elevation at which the kit is to be positioned according to the pool water level to provide proper operation of the prefabricated vacuum relief safety kit.

5. A prefabricated vacuum relief safety kit for preventing the entrapment of or harm to a swimmer at a suction outlet fitting in a swimming pool equipped with a pump for drawing water from the pool, the prefabricated vacuum relief safety kit comprising:

generally vertically disposed pipes including a first pipe mounted within a second pipe and a flow space between the first and second pipes and sized to provide a head of fluid sufficient to allow normal operation of a swimming pool pump with the vertical dimensions of the kit being predetermined by the desired built-in safe limitation of maximum suction by gravity generally limited to the pressure differential that can be attained by the fluid head;

a generally horizontally disposed connection for connecting to the drain line of a swimming pool;

an outlet of the upper vertically disposed pipe exposed to the atmosphere to allow air to be drawn into the vertically disposed pipes when the drain line is unable to draw water from a pool to relieve the suction in the drain line.

6. A prefabricated vacuum relief safety kit for a swimming pool as recited in claim 1 wherein the vertically disposed pipes comprise a single external pipe and a single internal pipe.

7. A prefabricated vacuum relief safety kit for a swimming pool as recited in claim 1 wherein the vertically disposed pipes comprise a single external pipe and at least two internal pipes.

8. A method for preventing the entrapment of or injury to a swimmer at a suction outlet fittings in a swimming pool equipped with a pump for drawing water from the pool, the method comprising the steps of:

connecting a prefabricated vacuum relief safety kit having generally vertically disposed inner and outer pipes sized to provide a head of fluid between the inner surface of the outer pipe and the inner surface of the inner pipe and sufficient to allow normal operation of a swimming pool pump with the vertical dimensions of the kit being predetermined by the desired built-in safe limitation of maximum suction by gravity generally limited to the pressure differential that can be attained by the fluid head;

connecting a generally horizontally disposed connection on the safety kit to the drain line of a swimming pool; and exposing an outlet on one of the vertically disposed pipes to the atmosphere for allowing air to be drawn into the vertically disposed pipes when the drain line is unable to draw water from a pool to reduce the suction in the drain line.

9. A method for preventing the entrapment of or injury to a swimmer as recited in claim 8 wherein the vertically disposed pipes comprise a single external pipe and a single internal pipe.

10. A method for preventing the entrapment of or injury to a swimmer as recited in claim 8 wherein the vertically disposed pipes comprise a single external pipe and at least two internal pipes.

* * * * *